US007114337B2

(12) United States Patent
Cazalens et al.

(10) Patent No.: US 7,114,337 B2
(45) Date of Patent: Oct. 3, 2006

(54) AIR/FUEL INJECTION SYSTEM HAVING COLD PLASMA GENERATING MEANS

(75) Inventors: Michel Cazalens, Bourron Marlotte (FR); Frederic Beule, Brunoy (FR)

(73) Assignee: Snecma Moteurs, Paris (FR)

( * ) Notice: Subject to any disclaimer, the term of this patent is extended or adjusted under 35 U.S.C. 154(b) by 108 days.

(21) Appl. No.: 10/922,935

(22) Filed: Aug. 23, 2004

(65) Prior Publication Data

US 2005/0044854 A1 Mar. 3, 2005

(30) Foreign Application Priority Data

Sep. 2, 2003 (FR) ..... 03 10379

(51) Int. Cl.
*F02C 1/00* (2006.01)
*F02G 3/00* (2006.01)

(52) U.S. Cl. ..... 60/737; 60/202; 60/748

(58) Field of Classification Search ..... 60/737, 60/748, 202, 740

See application file for complete search history.

(56) References Cited

U.S. PATENT DOCUMENTS 3,110,294 A 11/1963 Nyman
5,367,869 A * 11/1994 DeFreitas ..... 60/776
5,515,681 A * 5/1996 DeFreitas ..... 60/740
5,588,299 A * 12/1996 DeFreitas ..... 60/740
5,590,517 A * 1/1997 DeFreitas ..... 60/776
5,628,180 A * 5/1997 DeFreitas ..... 60/776
5,640,841 A 6/1997 Crosby
5,673,550 A * 10/1997 Few et al. ..... 60/776
5,673,554 A * 10/1997 DeFreitas et al. ..... 60/39.821
5,689,949 A * 11/1997 DeFreitas et al. ..... 60/776
5,784,889 A 7/1998 Joos et al.
5,802,854 A * 9/1998 Maeda et al. ..... 60/737
5,845,480 A * 12/1998 DeFreitas et al. ..... 60/776
6,453,660 B1 9/2002 Johnson et al.
6,912,857 B1 * 7/2005 Schmotolocha et al. ..... 60/776

* cited by examiner

*Primary Examiner*—William H. Rodriguez
(74) *Attorney, Agent, or Firm*—Oblon, Spivak, McClelland, Maier & Neustadt, P.C.

(57) ABSTRACT

A system for injecting an air/fuel mixture into a turbomachine combustion chamber, including a hollow tubular structure for the flow of the air/fuel mixture into the combustion chamber; a fuel injection device placed at an upstream end of the hollow tubular structure, and an air injection device placed downstream of the fuel injection device. The system also includes a cold plasma generator placed downstream of the air injection device so as to generate active species in the flow of the air/fuel mixture and to cause prefragmentation of the molecules of the air/fuel mixture. The system further includes a device for controlling the cold plasma generator depending on the speed of operation of the turbomachine.

16 Claims, 4 Drawing Sheets

AIR/FUEL INJECTION SYSTEM HAVING COLD PLASMA GENERATING MEANS

BACKGROUND OF THE INVENTION

The present invention relates to the general field of systems for injecting an air/fuel mixture into a turbomachine combustion chamber. It relates more particularly to an injection system provided with a cold plasma generator capable of controlling the reactivity of the air/fuel mixture during its injection into the combustion chamber.

The main objective of the conventional process of designing and optimizing a turbomachine combustion chamber is to reconcile the operational performance characteristics of the chamber (combustion efficiency, stability range, ignition and relight range, lifetime of the combustion region, etc.) according to the envisaged mission of the aircraft on which the turbomachine has been mounted, while minimizing the polluting emissions (nitrogen oxides, carbon monoxide, unburnt hydrocarbons, etc.). To do this, it is possible to vary in particular the nature and the performance characteristics of the system for injecting the air/fuel mixture into the combustion chamber, the distribution of the dilution air in the chamber and the dynamics of the air/fuel mixture in the chamber.

The combustion chamber of a turbomachine is typically composed of several systems, namely a system for injecting an air/fuel mixture into a flame tube, a cooling system and a dilution system. The combustion mainly takes place within a first part of the flame tube (primary zone) in which the flame is stabilized by means of air/fuel mixture recirculation zones induced by the air flow coming from the injection system. In this primary zone of the mixing tube, various physical phenomena occur, namely injection and atomization into fine droplets of the fuel, evaporation of the droplets, mixing of the fuel vapours with the air and chemical oxidation reactions in which the fuel is oxidized by the oxygen of the air. In the second part of the mixing tube (dilution zone), the chemical activity occurring is weaker and the flow is diluted by means of dilution holes.

To reduce the polluting emissions, especially nitrogen oxide emissions (of the NOx type), it is known to try to eliminate those zones of the flame tube where the temperature is above about 1800 K. To do this, it is necessary for the combustion flame to be in the presence of a rich or lean air/fuel mixture. For example, the air/fuel mixture of that zone of the flame tube where the chemical reactions take place may be made lean by increasing the flow rate of air assigned to the combustion. In this case, it thus helps in evaporating and mixing more and more fuel with the air before feeding the flame located in the combustion zone. The combustion flame therefore experiences a reduction in its richness.

However, increasing the air flow rate is not sufficient to completely eliminate the zones of stoichiometric mixing within the combustion region. In general, making the combustion leaner results in an increase in the vulnerability of the combustion region to extinction, so that the idling phases of the engine can no longer be obtained.

To solve this problem, engine designers have developed the concept called "staged combustion" which may take two forms, namely what are called "double-staged" combustion chambers and "multipoint" injection systems.

Double-staged combustion chambers are chambers in which the fuel injectors are distributed around what is called a "pilot" head and around what is called a "take-off" head. The pilot head operates permanently and thus prevents the combustion region from being extinguished, whereas the take-off head is designed to reduce NOx-type emissions. Also this solution appears satisfactory, a double-staged chamber is still difficult to control and is expensive owing to the doubling of the number of fuel injectors as compared with a conventional single-head combustion chamber.

"Multipoint" injection systems for injecting the air/fuel mixture are systems in which the injection of air and fuel takes place via several independent ducts and is regulated according to the operating speed of the turbomachine. The main drawback of such multipoint injection systems lies in the complexity of the various fuel circuits and of the regulating system.

Patent U.S. Pat. No. 6,453,660 teaches a multipoint injection system provided with a hot plasma generator. In that document, provision is made to equip the end of the main fuel injector with a hot plasma generating device. A high-energy discharge occurs in the fuel flow, thus allowing the fuel molecules to be ionized and partly dissociated. However, such an injection system is not completely satisfactory. Firstly, the multipoint architecture remains complex and difficult to control. Secondly, the high-energy discharge takes place only in the main fuel flow, which limits the effectiveness of such an injection system in combating the risk of extinction of the combustion region.

SUBJECT AND SUMMARY OF THE INVENTION

The main object of the present invention is therefore to alleviate such drawbacks by providing a system for injecting an air/fuel mixture into a combustion chamber which makes it possible to increase the resistance of the combustion region to flameout, while still maintaining a simple architecture and limiting polluting emissions.

For this purpose, a system is provided for injecting an air/fuel mixture into a turbomachine combustion chamber, comprising a hollow tubular structure for the flow of the air/fuel mixture into the combustion chamber, fuel injection means placed at an upstream end of the hollow tubular structure, and air injection means placed downstream of the fuel injection means, characterized in that it furthermore includes cold plasma generating means placed downstream of the air injection means so as to generate active species in the flow of the air/fuel mixture and to cause prefragmentation of the molecules of the air/fuel mixture, and means for controlling the cold plasma generating means depending on the speed of operation of the turbomachine.

The cold plasma generator allows the characteristic times of the chemical reactions to be adapted according to the operating speed of the turbomachine. The characteristic times of the chemical reactions are controlled by the production and injection of active species (radical species and excited species) into the flow of the air/fuel mixture and by the prefragmentation of the air and fuel molecules.

In this way, it is possible to increase the resistance of the combustion region to extinction and therefore to ensure combustion stability, especially at the low operating speeds of the turbomachine, while still making it possible to limit polluting emissions.

The cold plasma generating means may be suitable both for aeromechanical-type injection systems and for aerodynamic-type injection systems.

The cold plasma generating means may comprise at least one pair of electrodes connected to an AC current generator, which is controlled by the control means.

Alternatively, and depending on the way they are fitted, these cold plasma generating means may comprise a solenoidal winding connected to an AC current generator, which is also controlled by the control means.

Thus, the present invention can be easily adapted to known air/fuel mixture injection systems without resulting in substantial modifications of these injection systems.

The cold plasma generating means may be linked with just one or with all of the injection systems of one and the same combustion chamber, thereby making it possible to improve the operation of the existing combustion chambers.

The injection system according to the present invention may also operate at operating points of the turbomachine in which the combustion is stabilized in such a way that the combustion efficiency is increased for these points. For example, if we consider a relight point at altitude during windmilling, the volume of the combustion region must be sufficient to ensure combustion efficiency allowing the turbomachine to accelerate. Under these conditions, the present invention allows the volume of the combustion regions to be reduced and therefore the mass of the turbomachine to be reduced.

In addition, by pushing back the combustion chamber extinction limits, the invention makes it possible to dispense with the pilot head fuel circuit in the case of double-staged chambers, but also in the case of chambers based on multipoint injection systems.

Finally, the present invention makes it possible to simplify the combustion chamber ignition systems by incorporating this function into the injection system. Ignition is in fact achieved by the cold plasma generating means supplied with suitable energy and at a suitable frequency. It is thus possible to dispense with the conventional spark plug ignition devices and to avoid the problems that are associated therewith (cooling of the body and of the tip of the spark plug, perturbation in the cooling of the combustion region, lifetime of the spark plug, etc.).

BRIEF DESCRIPTION OF THE DRAWINGS

Other features and advantages of the present invention will become apparent from the description given below, with reference to the appended drawings which illustrate an embodiment thereof which is devoid of any limiting character. In the figures.

DETAILED DESCRIPTION OF AN EMBODIMENT

Figure 1:
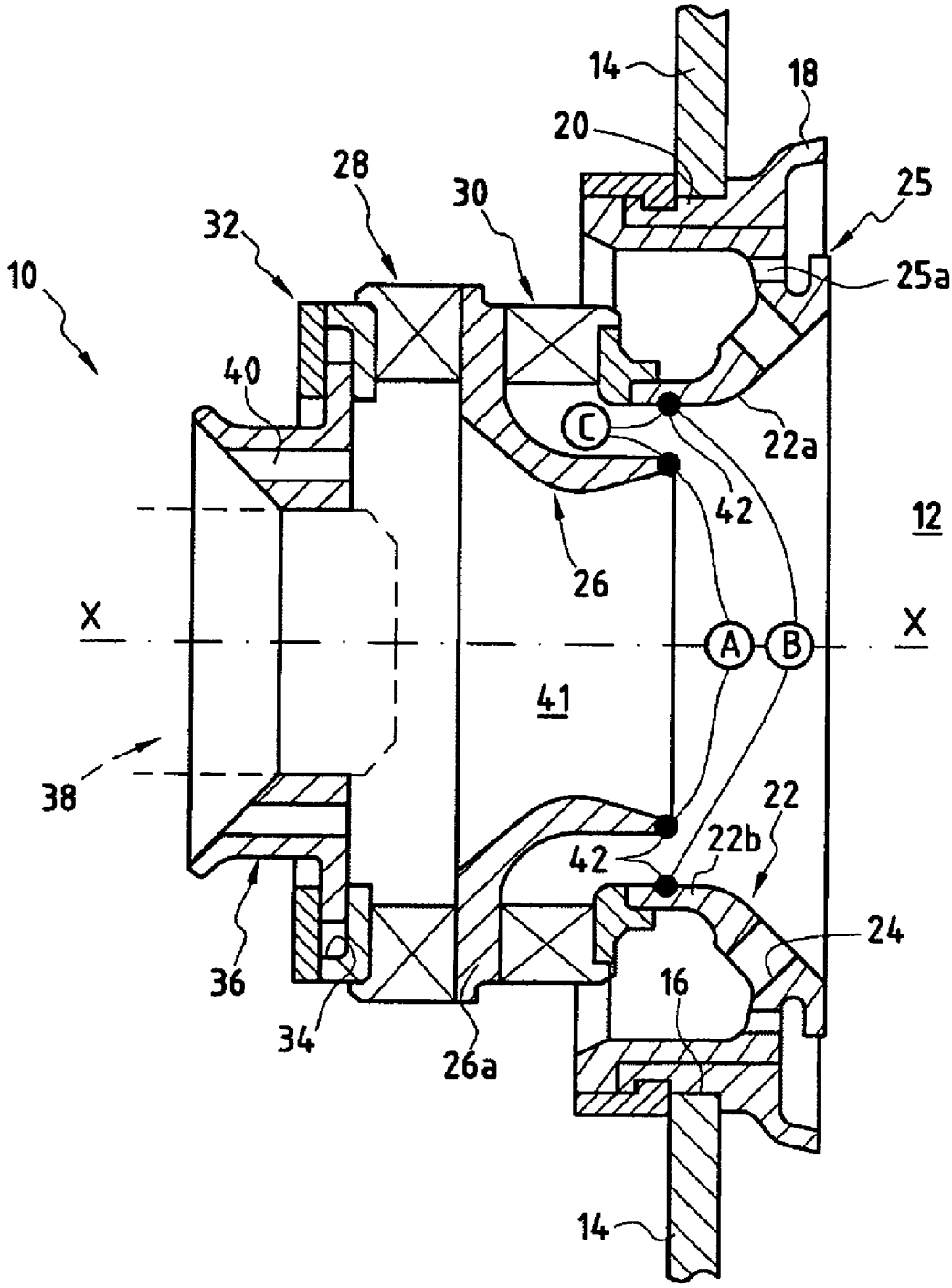
FIG. 1 is a longitudinal sectional view of an injection system according to one embodiment of the invention.

FIG. 1 shows, in a longitudinal section, an injection system according to one embodiment of the invention. In this embodiment, the injection system is of the aeromechanical type.

The injection system 10 of longitudinal axis X—X is essentially composed of a tubular structure for the flow of an air/fuel mixture towards the combustion region of a combustion chamber 12 of a turbomachine. This air/fuel mixture is intended to be burnt in the combustion chamber 12.

The combustion chamber 12 is, for example, of the annular type. It is bounded by two annular walls (not shown in FIG. 1) which are spaced apart radially with respect to the axis of the turbomachine and are connected upstream by a chamber back wall 14. The chamber back wall 14 has a plurality of ports 16 uniformly spaced apart along a circle around the axis of the turbomachine. Fitted into each of these ports 16 is an injection system 10 according to the invention. The gases emanating from the combustion of the air/fuel mixture flow toward the downstream end in the combustion chamber 12 in order to feed a high-pressure turbine (not shown) placed at the exit of the combustion chamber.

An annular deflector 18 is fitted into the port 16 by means of a bush 20. This deflector is fitted so as to be parallel to the chamber back wall 14 and acts as a heat shield against the radiation of the combustion flame.

A bowl 22 is fitted inside the bush 20. This bowl 22 has a wall 22*a* flared out towards the downstream end along the extension of an approximately cylindrical wall 22*b* placed coaxially with the longitudinal axis X—X of the injection system 10. Through its flare angle, the bowl 22 allows the air/fuel mixture to be distributed in the primary zone of the combustion region. Moreover, the flared wall 22*a* of the bowl has a plurality of holes 24 for introducing air into the combustion region. These holes 24 make it possible to recentre the flow of the air/fuel mixture around the longitudinal axis X—X on the output side of the bowl.

The bowl 22 has an annular collar 25 that extends parallel to the chamber back wall 14. As in the case of the deflector 18, this collar 25 forms a heat shield between the radiation of the combustion flame and the bowl 22. The collar is cooled by the impact of air flowing via orifices 25*a* passing through the flared wall 22*a* of the bowl.

The cylindrical wall 22*b* of the bowl 22 surrounds a venturi 26 having an internal profile of convergent-divergent shape. The venturi 26 makes it possible to delimit the air flows emanating from an internal swirler 28 and from an external swirler 30. At its upstream end, the venturi 26 has a radial flange 26*a* separating the internal swirler 28 from the external swirler 30.

The internal swirler 28 is of radial type. It is placed upstream of the venture 26 and delivers an internal radial air stream inside the venture. The external swirler 30 is also of radial type. It is placed upstream of the cylindrical wall 22*b* of the bowl 22 and delivers an external radial air stream between the venturi 26 and the cylindrical wall 22*b* of the bowl 22. The internal 28 and external 30 swirlers rotate the flow of the air/fuel mixture and thus increase the turbulence and shearing so as to promote atomization of the fuel and mixing thereof with the air.

Upstream, the internal swirler 28 is fastened to a retaining piece 32 that has an annular groove 34 open on the side facing the longitudinal axis X—X of the injection system. A support ring 36 is fitted into the annular groove 34. This support ring 36 allows the downstream end of a fuel injector 38 to be fastened so as to be centred on the longitudinal axis X—X of the injection system. The support ring 36 can move radially in the annular groove 34 so as to make it possible to take up any slack that the thermal stresses to which the various elements of the injection system 10 are subjected may generate.

In its part in contact with the fuel injector 38, the support ring 36 is pierced by a plurality of orifices 40 uniformly spaced along a circle around the longitudinal axis X—X of the injection system. These orifices 14 act as a purge, ventilating the fuel nozzle 38 and preventing the formation of coke at the downstream end of the latter.

The support ring 36, the internal 28 and external 30 swirlers, the venturi 36 and the bowl 22 thus form the hollow tubular structure 41 of the injection system 10 through which the air/fuel mixture flows.

On the upstream side, the fuel injector 38 is fastened to an injector arm (not shown). After the fuel has flowed through the injector arm, it is sprayed by the injector 38 in the form of a fuel cone that partly strikes the venturi 26. Once sprayed, the fuel is mixed with the air coming from the internal 28 and external 30 swirlers and from the holes 24 in the bowl 22.

On leaving the bowl 22, the fuel is sprayed in the form of fine droplets owing to the aerodynamic shearing effect resulting from the differences between the velocity of the liquid flow and that of the gas flow. The air/fuel mixture thus formed is then introduced into the combustion chamber 12, to be burnt therein.

According to the invention, the injection system 10 further includes cold plasma generating means so as to generate active species in the flow of the air/fuel mixture and to cause prefragmentation of the molecules of the air/fuel mixture. Control means are also provided so as to control these cold plasma generating means according to the operating speed of the turbomachine.

In the embodiment of the injection system illustrated by FIG. 1, these cold plasma generating means may be placed either around the downstream end of the venturi 26 (arrangement A), or around the upstream end of the bowl 22 (arrangement B), or around the downstream end of the venturi 26 and around the upstream end of the bowl 22 (arrangement C).

Figure 2A:
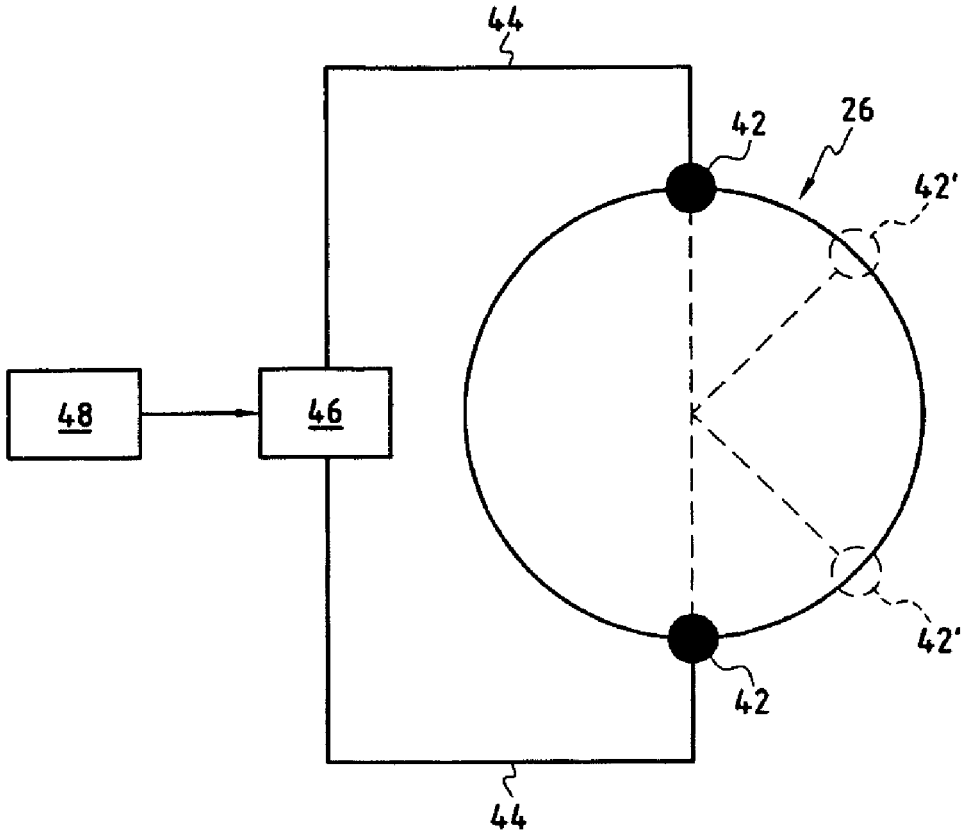
FIGS. 2A and 2B illustrate two versions of how the cold plasma generating means are fitted into the injection system according to the invention.

FIG. 2A illustrates the arrangement A of the cold plasma generating means around the downstream end of the venturi 26. This figure shows schematically, in front view, the circular downstream end of the venturi.

In this configuration, the cold plasma generating means are produced by at least one pair of electrodes 42 that are placed on the circumference of the downstream end of the venturi 26. These electrodes 42 are connected via electrical wires 44 to an AC current generator. The current generator is controlled by a control system 48 described later.

In FIG. 2A, the electrodes 42 are placed along one and the same diameter of the venturi 26, that is to say they are aligned radially one with respect to the other. However, as illustrated by the dotted lines, there may be a pair of electrodes 42' that are offset radially one with respect to the other, being placed on different radii of the venturi 26.

Depending on the nature and the requirement of the application, there may be a larger number of pairs of electrodes. These electrodes are then distributed angularly around the circumference of the venturi, for example in a uniform manner. Moreover, in the case of several pairs of electrodes, these pairs may be supplied by the AC current generator 46 simultaneously or sequentially.

Alternatively, in the case of an arrangement on the downstream end of the venturi, the cold plasma generating means may also be produced in the form of a solenoidal winding connected to the AC current generator. In this variant (not illustrated), the external surface of the venturi has a solenoidal winding.

The arrangement of the cold plasma generating means around the upstream end of the bowl 22 (arrangement B) corresponds to the arrangement A described above and therefore will not be repeated.

Figure 2B:
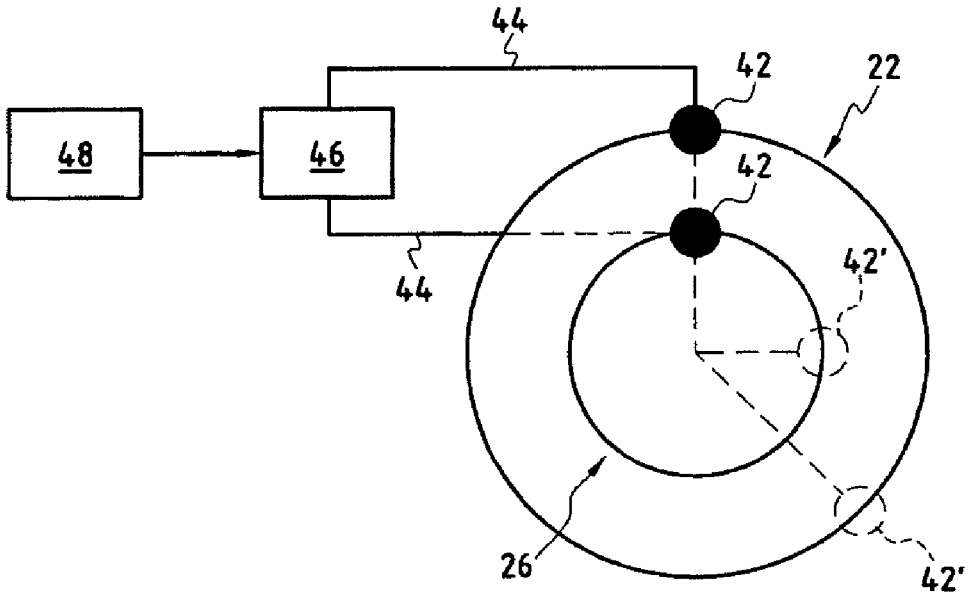

FIG. 2B illustrates the arrangement C of the cold plasma generating means around the downstream end of the venturi 26 and around the upstream end of the bowl 22. In this figure, the venturi 26 and the bowl 22 each have an approximately circular cross section and are placed concentrically one with respect to the other.

In this configuration, the cold plasma generating means are produced by at least one pair of electrodes 42, one of the electrodes of which is placed on the circumference of the downstream end of the venturi 26 and the other electrode of which is placed on the circumference of the upstream end of the bowl 22. These electrodes 42 are also connected via electrical wires 44 to an AC current generator 46 controlled by a control system 48.

In FIG. 2B, the electrodes 42 are placed on one and the same radius of the ring defined by the downstream end of the venturi 26 and the upstream end of the bowl 22, that is to say they are aligned radially one with respect to the other. However, as illustrated by the dotted lines, there may be a pair of electrodes 42' that are offset radially one with respect to the other, being placed on different radii of the ring.

As in the case of the previous configuration, there may be a larger number of pairs of electrodes depending on the nature and the requirement of the application. In this case, the arrangement of these pairs of electrodes may vary along the circumference of the venturi and of the bowl. The pairs of electrodes may also be supplied simultaneously or sequentially.

In the two configurations described above with reference to FIGS. 2A and 2B, the pairs of electrodes (or the solenoidal winding) make it possible to create, by means of the AC current generator 46 connected to the control system 48, an electrical discharge in the air/fuel mixture flowing between the electrodes (or along the inside of the solenoidal winding).

When the air/fuel mixture passes through this electrical discharge, the air and fuel molecules become ionized and partly dissociated. The fuel molecules are partly dissociated into radical species of the $C_xH_y$ ($C_2H_2$, $CH_4$, etc.) type. Likewise, the oxygen of the air is dissociated and ionized ($O^+$, etc.). this prefragmentation of the fuel and air molecules then makes further fragmentation of these molecules during combustion easier.

The parameters of the AC current generator 46 (duration of the electrical pulses, voltage, repetition rate, etc.) are controlled by the control system 48 according to the operating speed of the turbomachine, in relation to the active species (radical species and excited species) that it is desired to produce, in relation to the desired degree of prefragmentation of the air and fuel modules and in relation to the intended function (ignition, relight at altitude, extension of the stability range, active control of the combustion region, etc.).

However, the AC current generator 46 has the feature of allowing "cold" plasmas to be generated. Compared with "hot" plasmas, cold plasmas are characterized by an electrical discharge of the "streamer" type, that is to say by the propagation of an ionization front. Cold plasmas are also characterized by thermodynamic disequilibrium in which the temperature of the electrons emitted during the electrical discharge is very high compared with that of the air/fuel mixture flowing through the electrical discharge. This feature has the main advantage of allowing active radical species to be produced in the flow of the air/fuel mixture with a lower energy expenditure than with hot plasmas.

Such an AC current generator 46 allowing generation of cold plasmas delivers electrical pulses having a duration of between 2 and 50 nanoseconds, preferably between 2 and 30 nanoseconds. In comparison, an electrical current generator for the production of hot plasmas delivers electrical pulses typically having a duration of the order of one hundred milliseconds.

Moreover, when an active control function for controlling the combustion region is necessary, the control system 48 can use information picked up in real time within the combustion region.

For example, provision may be made for connecting the control system 48 to an instability detector placed in the combustion chamber. Such an instability detector measures the pressure (or any other parameter) inside the combustion chamber and transmits it in real time to the control system. In another example, it is also possible to connect the control system to an optical detector for detecting the combustion flame. Such an optical detector thus makes it possible to inform the control system in real time in the event of a flameout.

An injection system in another embodiment of the invention will now be described with reference to FIG. 3. In this embodiment, the injection system is also of the aeromechanical type so that only the differences existing between it and the injection system illustrated by FIG. 1 will be explained in detail. In particular, compared with the injection system of FIG. 1, this injection system is of the LPP (Lean Premixed Prevaporized) type.

As in the case of the previously described embodiment, the injection system 50 of longitudinal axis Y—Y is essentially composed of a hollow tubular structure 51 for the flow of an air/fuel mixture into the combustion region of the combustion chamber 12 of a turbomachine.

An annular defector 52 is fitted into the port 16 made in the chamber back wall 14 by means of a bush 54. A bowl 56 forming a vaporizing and premixing tube is fitted inside the bush 54. This bowl 56 has a divergent downstream wall 56*a* that is formed in the extension of a convergent intermediate wall 56*b*, which is itself formed in the extension of an approximately cylindrical upstream wall 56*c* placed coaxially with the longitudinal axis Y—Y of the injection system.

In addition to the functions described in the previous embodiment, this bowl 56 makes it possible to feed the combustion region with a homogeneous lean air/fuel mixture so as to prevent stoichiometric combustion conditions that degenerate NOx-type emissions from being established in the combustion region.

The bowl 56 surrounds a first venturi 58. This first venturi 58 has the function of guiding air flowing through the holes 60 formed through the cylindrical wall 56*c* of the bowl 56, at its upstream end. This air is intended to cool the bowl 56 by flowing along the internal face of the latter.

The first venturi 58 surrounds a second venturi 62 that has an internal profile of convergent-divergent shape. The second venturi 62 delimits the air flows emanating from an internal radial swirler 64 and from an external radial swirler 66. The internal swirler 64 delivers a radial stream of air inside the second venturi 62 and the external swirler 66 delivers a radial stream of air between the first venturi 58 and the second venturi 62.

A fuel injector 68 centred on the longitudinal axis Y—Y of the injection systems is placed upstream of the internal swirler 64. This fuel injector is fastened to the injection system by means of a support ring 70.

The support ring 70, the internal 64 and external 66 swirlers, the venturis 58, 62 and the bowl 56 thus form the hollow tubular structure 51 of the injection system 50 through which the air/fuel mixture flows.

Figure 3:
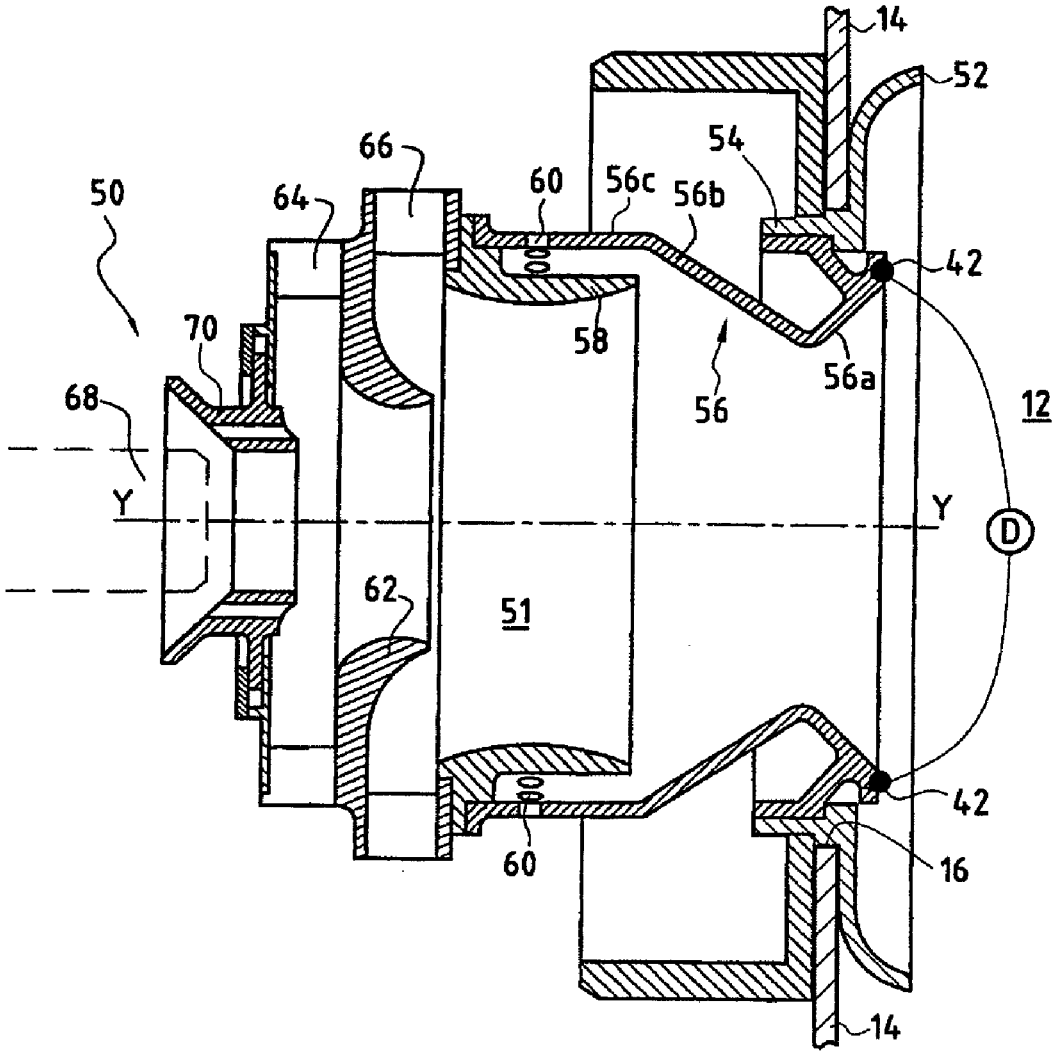
FIG. 3 is a longitudinal sectional view of an injection system according to another embodiment of the invention.

In this embodiment, the cold plasma generating means allowing active species to be generated in the flow of the air/fuel mixture and allowing the molecules of the air/fuel mixture to be prefragmented are placed around the downstream end of the bowl 56 (arrangement D in FIG. 3).

The arrangement D of the cold plasma generating means around the downstream end of the bowl 56 corresponds to the arrangement illustrated by FIG. 2A. As described above, the cold plasma generating means may thus be produced in the form of at least one pair of electrodes placed on the circumference of the downstream end of the bowl or else in the form of a solenoidal winding.

Of course, the alternative configurations described with reference to FIG. 2A are also applicable to this embodiment and the electrodes (or the solenoidal winding) are connected to the AC current generator controlled by the control system.

In this embodiment, the arrangement D of the cold plasma generating means makes it possible, on the one hand, to increase the stability range of the combustion region by pushing back the extinction limits in a lean air/fuel mixture medium and, on the other hand, to control the combustion region so as to reduce its vulnerability to combustion instabilities.

In this combustion region control case, it is necessary, as mentioned above, to install an instability detector or a combustion flame optical detector connected to the active control system of the AC current generator.

Figure 4:
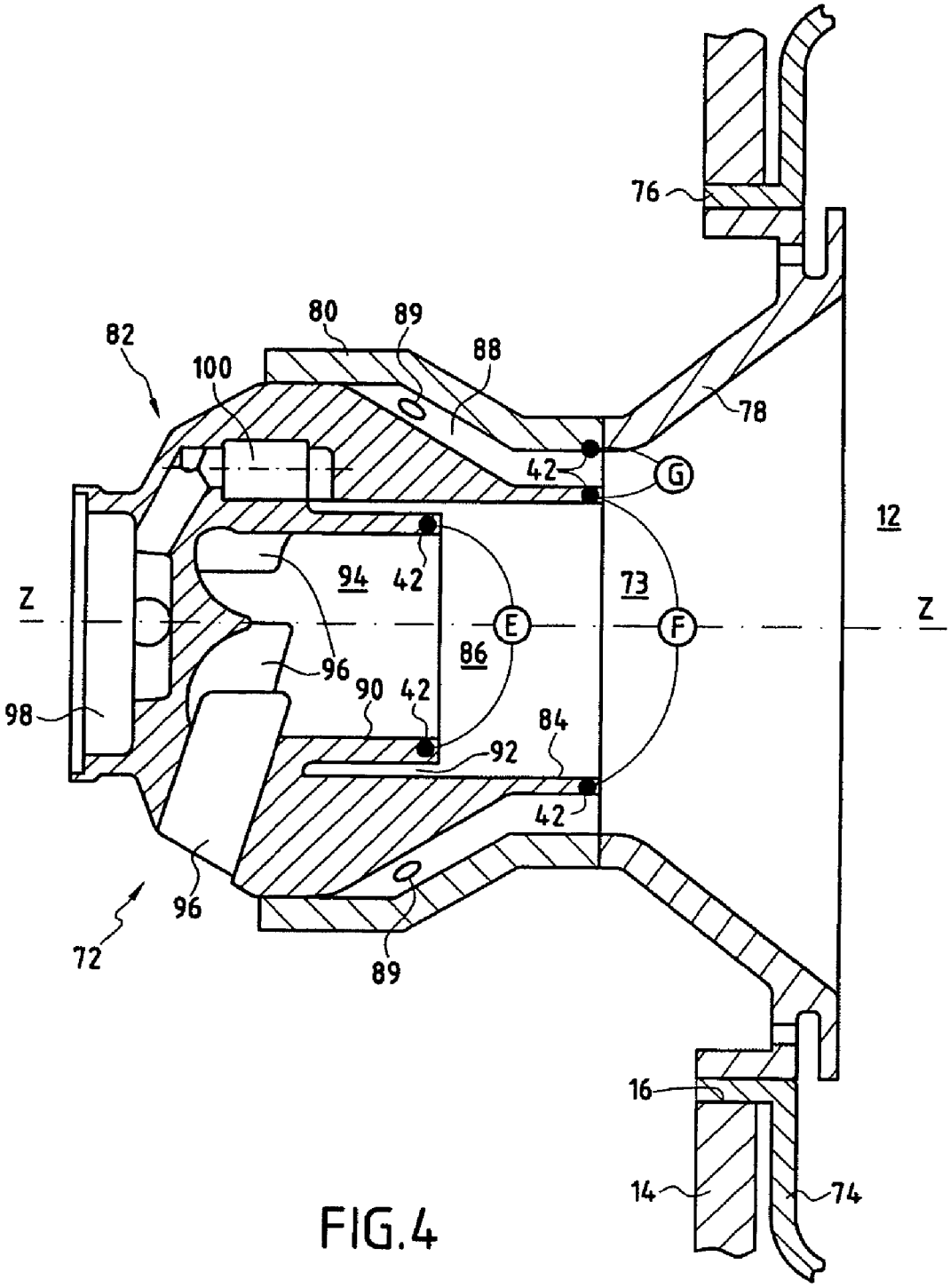
FIG. 4 is a longitudinal sectional view of an injection system according to yet another embodiment of the invention.

An injection system in yet another embodiment of the invention will now be described with reference to FIG. 4. In this embodiment, the injection system is of the aerodynamic type.

As in the case of the previous embodiments, the injection system 72 of longitudinal axis Z—Z is essentially composed of a hollow tubular structure 73 for the flow of an air/fuel mixture into the combustion region of the combustion chamber 12 of a turbomachine.

A deflector 74 is fitted into the port 16 made in the chamber back wall 16 by means of a bush 76. A bowl 78 is fitted inside the bush 76. This bowl has a wall that diverges towards the downstream end.

At its upstream end, the bowl 78 is extended by an annular retaining ring 80 that surrounds and holds in place a fuel injector 82 centred on the longitudinal axis Z—Z of the injection system.

The fuel injector 82 has a first tubular part 84 placed coaxially with the longitudinal axis Z—Z of the injection system 72. This first tubular part 84 defines a first axial internal volume 86 which opens out at its downstream end for the air/fuel mixture.

The external surface of the first tubular part 84 and the internal surface of the annular retaining ring 80 define between them a first annular passage 88. Air feed orifices 89 made through the retaining ring 80 open to the outside of the injector 82 and emerge in this first annular passage 88. These orifices 89 allow air to be injected at the downstream end of the first tubular part 84 in an approximately axial direction.

The interval surface of the first tubular part 84 of the fuel nozzle 82 surrounds a second tubular part 90 which is also placed coaxially with the longitudinal axis Z—Z of the injection system. The first tubular part 84 and the second tubular part 90 define between them a second annular passage 92. This second tubular part 90 furthermore defines a second axial internal volume 94 that opens out into the axial internal volume 86 of the first tubular part 84.

The fuel injector 82 also includes a plurality of air feed channels 96 opening to the outside of the injector and emerging in the second axial internal volume 94, at an upstream end of the second tubular part 90. These air feed channels 96 thus allow air to be injected at an upstream end of the second tubular part 90 in an approximately axial direction.

At its upstream end, the fuel injector 82 has at least one fuel inlet 98 in the form of a cylindrical recess. This cylindrical recess is fed with fuel via an injector arm (not shown).

Fuel feed channels 100 open out into this cylindrical recess 98 and emerge in the second annular passage 92. These fuel feed channels therefore allow fuel to be injected between the first tubular part 84 and the second tubular part 90.

The fuel injector 82, the retaining ring 80 and the bowl 78 thus form the hollow tubular structure 73 of the injection system 72.

In this injection system, the injected fuel is atomized by the air shearing effect. In fact, a film of fuel forms at the second annular passage 92. On leaving the second tubular part 90, this film of fuel is subjected to the action of the air emanating from the air feed channels 96 before being subjected, at the exit of the first tubular part 84, to the action of the air emanating from the first annular passage 88.

In this embodiment, the cold plasma generating means may be fitted in three different zones, namely around the downstream end of the second tubular part 90 (arrangement E), around the downstream end of the first tubular part 84 (arrangement F), or even around the downstream end of the annular retaining ring 80 and around the downstream end of the first tubular part 84 (arrangement G).

The arrangement E around the downstream end of the second tubular part 90 and the arrangement F around the downstream end of the first tubular part 84 both correspond to the arrangement illustrated by FIG. 2A and will therefore not be detailed. In both these cases, the cold plasma generating means may be produced in the form of at least one pair of electrodes or else in the form of a solenoidal winding.

The arrangement G around the downstream end of the annular retaining ring 80 and around the downstream end of the first tubular part 84 corresponds to the arrangement illustrated by FIG. 2B and will therefore not be detailed either. In this case, the cold plasma generating means may be produced in the form of at least one pair of electrodes.

Of course, the various alternative embodiments described with reference to FIGS. 2A and 2B also apply to the arrangements E, F and G of this embodiment and the electrodes (or the solenoidal winding) are connected to the AC current generator controlled by the control system.

The invention claimed is:

1. System for injecting an air/fuel mixture into a turbomachine combustion chamber, comprising:

a hollow tubular structure for the flow of the air/fuel mixture into the combustion chamber;

fuel injection means placed at an upstream end of the hollow tubular structure; and air injection means placed downstream of the fuel injection means;

cold plasma generating means placed downstream of the air injection means so as to generate active species in the flow of the air/fuel mixture and to cause prefragmentation of the molecules of the air/fuel mixture; and means for controlling said cold plasma generating means depending on the speed of operation of the turbomachine.

2. System according to claim 1, further comprising a fuel injector placed at an upstream end of the hollow tubular structure and allowing fuel to be injected into the hollow tubular structure in an approximately axial direction, an internal air swirler placed downstream of the fuel injector and allowing air to be injected into said hollow tubular structure in an approximately radial direction, an external air swirler placed downstream of the internal air swirler and allowing air to be injected into said hollow tubular structure in an approximately radial direction, a venturi interposed between the internal and external air swirlers, and a bowl placed downstream of the external air swirler.

3. System according to claim 2, wherein said cold plasma generating means are placed around a downstream end of the venturi.

4. System according to claim 2, wherein said cold plasma generating means are placed around an upstream end of the bowl.

5. System according to claim 2, wherein said cold plasma generating means are placed around a downstream end of the venturi and around an upstream end of the bowl.

6. System according to claim 1, further comprising a fuel injector placed at an upstream end of the hollow tubular structure and allowing fuel to be injected into the hollow tubular structure in an approximately axial direction, an internal air swirler placed downstream of the fuel injector and allowing air to be injected into the said hollow tubular structure in an approximately radial direction, an external air swirler placed downstream of the internal air swirler and allowing air to be injected into said hollow tubular structure in an approximately radial direction, a first venturi interposed between the internal and external air swirlers, a second venturi placed downstream of the external air swirler, and a premixing bowl placed downstream of the second venturi.

7. System according to claim 6, wherein said cold plasma generating means air placed around a downstream end of the premixing bowl.

8. System according to claim 1, further comprising:

a fuel injector comprising a first tubular part surrounding a second tubular part so as to define an annular passage between said first and second tubular parts;

an annular retaining ring surrounding said first tubular part of the fuel injector so as to define an annular passage between said annular retaining ring and said fuel injector;

a bowl placed in the downstream extension of the said annular retaining ring;

air feed orifices emerging in the annular passage between said retaining ring and the said fuel injector and allowing air to be injected downstream of the said first tublar part of the fuel injector;

air feed channels emerging at an upstream end of said second tubular part of the fuel injector; and fuel feed channels emerging in the annular passage between said first and second tubular parts and allowing fuel to be injected between the first and second tubular parts.

9. System according to claim 8, wherein said cold plasma generating means are placed around a downstream end of said second tubular part of the fuel injector.

10. System according to claim 8, wherein said cold plasma generating means are placed around a downstream end of said first tubular part of the fuel injector.

11. System according to claim 8, wherein said cold plasma generating means are placed around a downstream end of said first tubular part of the fuel injector and around a downstream end of the annular retaining ring.

12. System according to any of claims 1 to 11, wherein said cold plasma generating means comprise at least one pair of electrodes connected to an AC current generator.

13. System according to claim 12, wherein the electrodes of said pair of electrodes are aligned radially one with respect to the other.

14. System according to claim 12, wherein the electrodes of said pair of electrodes are offset radially one with respect to the other.

15. System according to any one of claims 3, 4, 7, 9 and 10, wherein said cold plasma generating means comprise a solenoidal winding connected to an AC current generator.

16. System according to claim 15, wherein said AC current generator delivers electrical pulses of between 2 and 50 nanoseconds duration.

* * * * *